United States Patent [19]

Olson

[11] Patent Number: 4,605,255

[45] Date of Patent: Aug. 12, 1986

[54] LOAD CLAMP HAVING MOTOR-POWERED SCREW-TYPE CLAMPING ACTUATOR CAPABLE OF ACCURATE POSITIONING AND HIGH CLAMPING FORCE

[75] Inventor: John E. Olson, Portland, Oreg.

[73] Assignee: Cascade Corporation, Portland, Oreg.

[21] Appl. No.: 677,929

[22] Filed: Dec. 4, 1984

[51] Int. Cl.[4] ..... B66C 1/66

[52] U.S. Cl. ..... 294/67.33; 294/119.1; 414/621

[58] Field of Search ..... 294/67.33, 103.1, 119.1; 414/621, 653, 685, 667

[56] References Cited

U.S. PATENT DOCUMENTS

| | | | |
|---|---|---|---|
| 2,618,502 | 11/1952 | Breslav | 294/67.33 |
| 2,706,570 | 4/1955 | Jewell et al. | 414/621 |
| 2,726,780 | 12/1955 | Rodman | 414/621 |
| 2,846,018 | 8/1958 | Puckett | 414/621 |
| 2,911,793 | 11/1959 | Arnot | 414/621 |
| 2,959,445 | 11/1960 | Breslav | 294/119.1 |
| 3,166,707 | 1/1965 | Quayle | 414/621 |
| 4,049,140 | 9/1977 | Roose | 414/621 |
| 4,381,166 | 4/1983 | Smart | 414/667 |

*Primary Examiner*—James B. Marbert

*Attorney, Agent, or Firm*—Chernoff, Vilhauer, McClung & Stenzel

[57] ABSTRACT

A carton clamp having a frame adapted to be mounted on a materials-handling machine, especially an automatically guided vehicle, includes clamp arms coupled directly together, independently of the frame, by motor-driven screw-type linear actuators which selectively open and close the arms. A centering assembly coupled to each clamp arm corrects for any imbalance of clamp arm speeds relative to the frame which may occur due to the fact that the screw actuators are free to move relative to the frame. The direct interconnection of the clamp arms by the screw actuators effectively doubles the clamping force which would otherwise be obtainable if the actuators were fixed to the frame.

12 Claims, 3 Drawing Figures

LOAD CLAMP HAVING MOTOR-POWERED SCREW-TYPE CLAMPING ACTUATOR CAPABLE OF ACCURATE POSITIONING AND HIGH CLAMPING FORCE

BACKGROUND OF THE INVENTION

This invention relates to a screw-actuated load clamp for mounting on a materials handling machine and, more particularly, to a carton clamp specially adapted for use on an automatically-guided vehicle.

Due to the advent of the microprocessor, warehouses and loading docks have become automated such that materials handling vehicles employing load clamps may be programmed to retrieve or stack loads automatically. Without a human operator, however, the mechanical actuation of the clamp arms must be extremely accurate. That is, without the intervention of a human to compensate for any mispositioning of the clamp arms, the interaction of the electronic control system and the mechanical clamp arm actuators must provide clamp arm positioning within very close tolerance limits.

In addition to the requirement for highly accurate control of the clamp arms, the mechanical clamp arm actuators must also provide sufficient clamping force to support, by frictional gripping, loads which may weigh on the order of several thousand pounds. Hydraulic rams have normally been relied upon in the past to supply such clamping force in load clamps controlled by a human operator. In some of these hydraulically-actuated clamps, such as those exemplified by Rodman U.S. Pat. No. 2,726,780 and Quayle U.S. Pat. No. 3,166,207, each hydraulic ram is attached at one of its ends to a respective clamp arm, the other end being fixed to the clamp frame upon which the clamp arms are movably mounted. In such arrangement, if each ram produces the same predetermined force, two such rams are needed to produce a clamping force between the two arms equal to such predetermined force. In other arrangements, each end of a single hydraulic ram has been connected to a respective arm as exemplified by Jewell et al. U.S. Pat. No. 2,706,570, Arnot U.S. Pat. No. 2,911,793 and Roose U.S. Pat. No. 4,049,140. In the latter arrangements, only a single hydraulic ram producing a predetermined force is necessary to produce the same clamping force between the two clamp arms, thereby effectively doubling the clamping force provided by each ram. However, a drawback of the latter arrangements, which dispense with any fixed coupling between the ram and the clamp frame, is that the ram and clamp arms thereby become freely movable with respect to the frame producing what will hereinafter be referred to as a "free-floating" configuration. Such free-floating configurations are incapable of controlling clamp arm position.

Although hydraulic rams in either one of the above-described two arrangements have normally been relied upon in the past to supply clamping force in load clamps controlled by a human operator, such rams are not well adapted for clamp arm actuation when used with automatically-guided vehicles because of the expense and difficulty of interfacing them with a microprocessor so as to achieve the high degree of accuracy needed for automatic operation. Moreover, in some cases, the absence of a convenient source of pressurized fluid dictates against the use of hydraulic rams in clamps for automatically guided vehicles.

In the past there have been available electric motor-driven screw-type linear actuators, which can provide a high degree of accuracy for positioning mechanical elements, which do not require a source of pressurized hydraulic fluid, and which can be easily interfaced with microprocessor-based electrical controls. However, with a few exceptions such as those shown in Smart U.S. Pat. No. 4,381,166 and Puckett U.S. Pat. No. 2,846,018, screw-type linear actuators have not been favored over hydraulic actuators in vehicular load-handling devices. When they are used, it is normally not for the purpose of providing a clamping force but merely to position mechanical elements. This is because screw-type linear actuators are generally capable of producing far less force in relation to their size than are hydraulic ram assemblies. A free-floating screw-type actuator would at least tend to double the clamping force obtainable from the actuator for the reasons described previously, but this would introduce the problems of how compatibly to make the actuator both free-floating and motor-actuated, and of how to provide precise position control of the screw-actuated arms compatibly with the free-floating arrangement.

Accordingly, what is needed is a load clamp specially adapted for use on automatically-guided vehicles by its utilization of motor-powered screw-type clamping actuators capable of compatibly providing both high clamping force and a high degree of positioning accuracy of the clamp arms.

SUMMARY OF THE INVENTION

The present invention satisfies the above-described need by providing a clamp frame having a pair of selectively openable and closeable clamp arms thereon interconnected with each other by one or more motor-powered screw actuators which are movable transversely relative to the clamp frame. The screw actuators each have mutually-cooperating turnable and nonturnable elements respectively, interconnecting the clamp arms for selectively closing them by turning the turnable element in one rotational direction and alternatively opening them by turning the turnable element in the opposite rotational direction. To maximize the clamping force, both the turnable and nonturnable elements of the screw actuators are movable transversely relative to the frame. A respective reversible motor is provided for turning each turnable element while permitting it to move transversely relative to the frame and, in the preferred embodiment, the motor also is movable transversely relative to the frame by virtue of being mounted on one of the clamp arms. In the latter case, the frame is configured to accommodate transverse movement of each motor without requiring the motor to occupy space otherwise available for the load.

The invention also includes an assembly for equalizing the speeds at which the respective clamp arms move transversely relative to the frame as the turnable element of each screw actuator rotates. This assembly preferably includes an endless chain movably connected to the frame and to the respective clamp arms to insure that the arms remain transversly equidistant from a predetermined point on the frame throughout their transverse movement.

It is therefore a principal object of this invention to provide a load clamp using a motor-driven, screw-type clamping actuator capable of both high clamping force and a high degree of positioning accuracy.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 2:
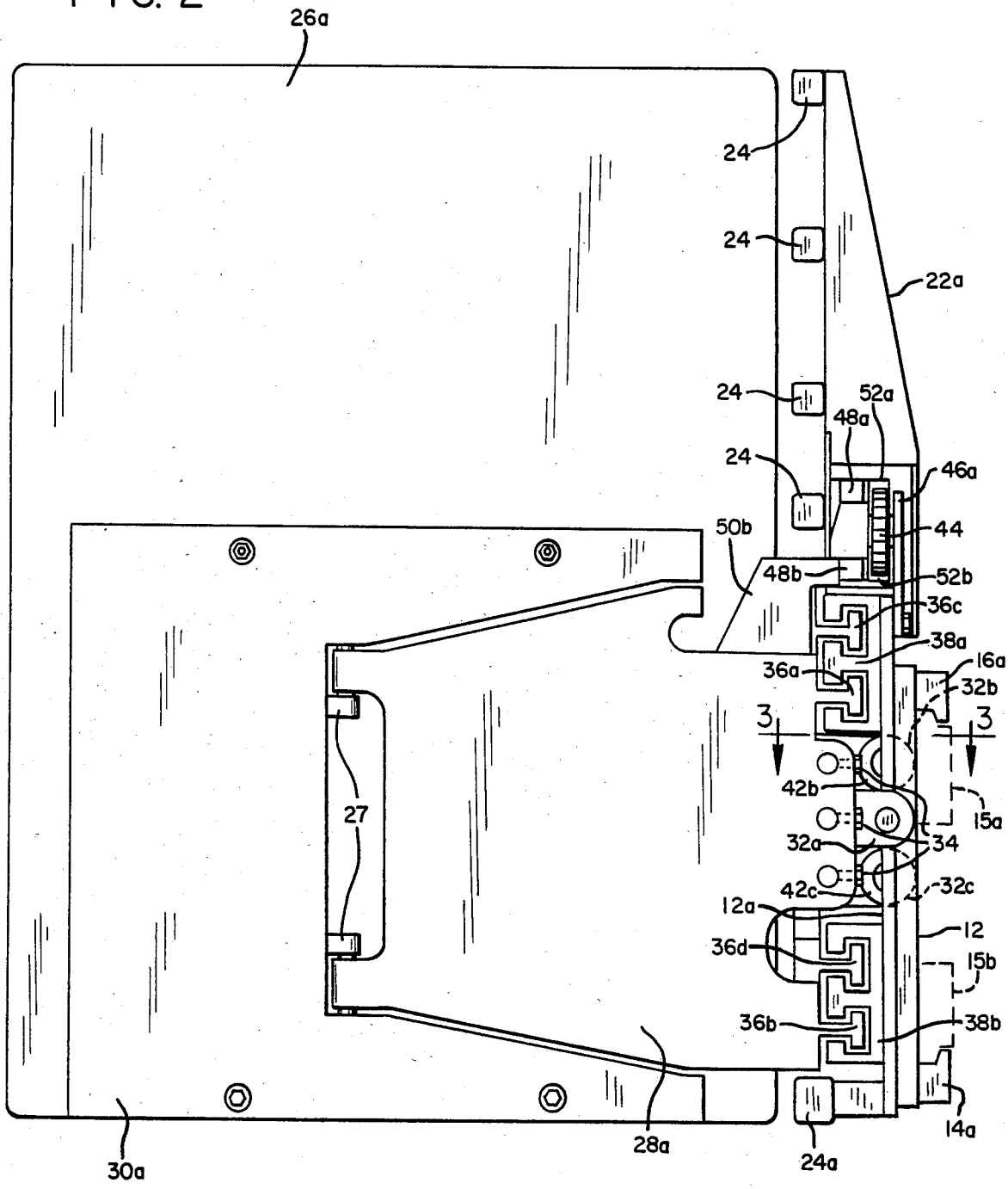
FIG. 2 is a side view of the carton clamp mechanism shown in FIG. 1.

The exemplary carton clamp mechanism 10 includes a support frame 12 having lower rotatable hooks 14*a*, 14*b*, 14*c* and 14*d* and upper fixed hooks 16*a* and 16*b* for connection to attachment mounting bars 15*a* and 15*b* (FIG. 2) which are part of a mast-mounted, vertically-movable load carriage on a materials handling vehicle, preferably of the automatically-guided type. The frame 12 includes a load backrest structure comprising brackets 20*a* and 20*b* supporting a pair of upper support posts 22*a* and 22*b* to which are mounted a plurality of transverse cross ribs 24. Together with lower transverse cross rib 24*a*, cross ribs 24 serve as stops defining the rearwardmost load position of the carton clamp.

A pair of load-engaging clamp pads 26*a* and 26*b* are pivotally connected by respective hinges such as 27 to a pair of clamp arms 28*a* and 28*b* by reinforced plate portions 30*a* and 30*b*, respectively. The clamp arms are mounted for transverse movement relative to the frame 12 by a plurality of slide members 36*a*, 36*b*, 36*c* and 36*d* which slidably fit within guides 38*a* and 38*b* on the frame 12. Clamp arm 28*a* is supported by slide members 36*a* and 36*b*, while clamp arm 28*b* is supported by slide members 36*c* and 36*d*. Connected directly between the clamp arms 28*a* and 28*b* are three motor-driven screw-type linear actuators 32*a*, 32*b* and 32*c*, respectively. Each end of these actuators is connected to a respective clamp arm 28*a* or 28*b* by a respective bolt 34 extending forwardly into the clamp arm 28*a* or 28*b*.

Figure 3:
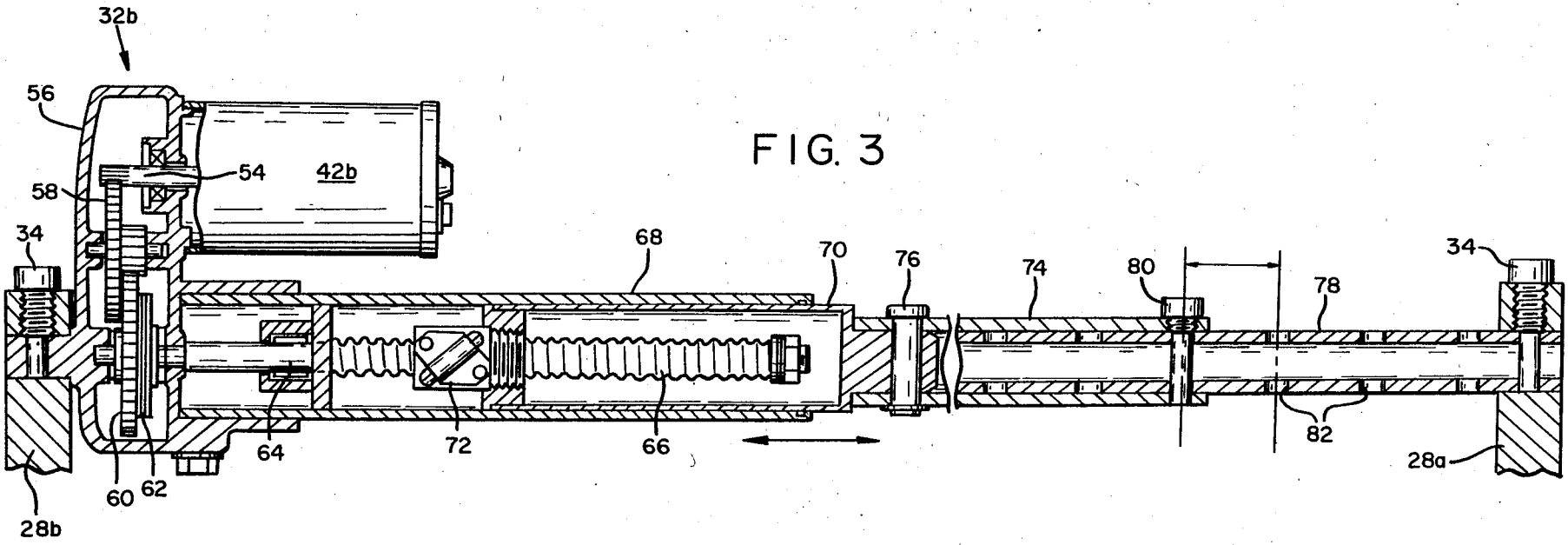
FIG. 3 is a partial sectional view of a screw-type linear actuator taken along line 3—3 of FIG. 2.

An exemplary form of the linear actuators 32*a*, 32*b* and 32*c*, all of which are identical, is shown in FIG. 3 with respect to actuator 32*b*. Actuator 32*b* includes a cylindrical electric motor 42*b* having an output shaft 54 extending into a gear housing 56 which is connected to clamp arm 28*b* by one of the bolts 34. The motor 42*b* is reversible by conventional switch actuation, so that shaft 54 can rotate in either a clockwise or counterclockwise direction. Output shaft 54 is connected to an idler gear 58 which drives an output gear 60. A slip clutch 62 couples the rotational output of the output gear 60 to a rotating shaft 64 which drives a rotatable elongate screw member 66 housed within a cylinder 68. Inside the cylinder 68 is a nonrotating telescoping tube 70 which has a nonrotatable follower 70 affixed thereto in engagement with the screw 66. The telescoping tube 70 has an extension tube 74 connected to its end by a pin 76, and a second extension tube 78 disposed within the extension 74 which may be adjusted for length by sliding the second extension 78 within the extension 74 and aligning a pin 80 cooperatively with any one of a number of adjustment bores 82. The second extension tube 78 is coupled to clamp arm 28*a* by another of the bolts 34. Rotation of the screw member 66 in one direction extends the telescoping tube 70 and thereby moves the clamp arms further apart, while rotation of the screw member 66 in the opposite direction retracts the tube 70 and draws the clamp arms more closely together. Both clamp arms move transversely relative to the frame 12 during these operations.

It will be appreciated from the foregoing description that the linear actuators 32*a*, 32*b* and 32*c* directly connect clamp arms 28*a* and 28*b* together, and are not mechanically connected to frame 12 other than through the slide members 36*a*, 36*b*, 36*c* and 36*d*. Thus the turnable and nonturnable elements of the actuators, as well as their motors 42*a*, 42*b* and 42*c*, move transversely with respect to the frame 12 in unison with the clamp arms. The force generated by each actuator is converted wholly into clamping force by its direct coupling between the clamp arms 28*a* and 28*b*, without an intermediate fixed coupling to the frame 12. The total clamping force therefore is the sum of the forces generated by the three actuators, any number of actuators being usable depending on the total clamping force required.

The particular mechanical mounting of the screw actuators to maximize the clamping force can be varied, so long as both the turnable and nonturnable elements of the screw actuators are movable transversely relative to the frame 12. For example, all of the motors could be on one side of the frame mounted for transverse movement in unison with the same clamp arm. Alternatively, the motors could be slidably mounted more centrally on the frame 12 for transverse movement relative thereto (but not in unison with the clamp arms) with screw elements projecting from each motor toward both clamp arms. In fact the motors could conceivably be fixed centrally to the frame if the turnable screw elements of the actuators were transversely slidable relative to the motors as, for example, by a splined connection. In some cases, moreover, the motor-driven turnable element of each actuator could be the follower rather than the screw element, the screw element being nonturnable in such case.

Figure 1:
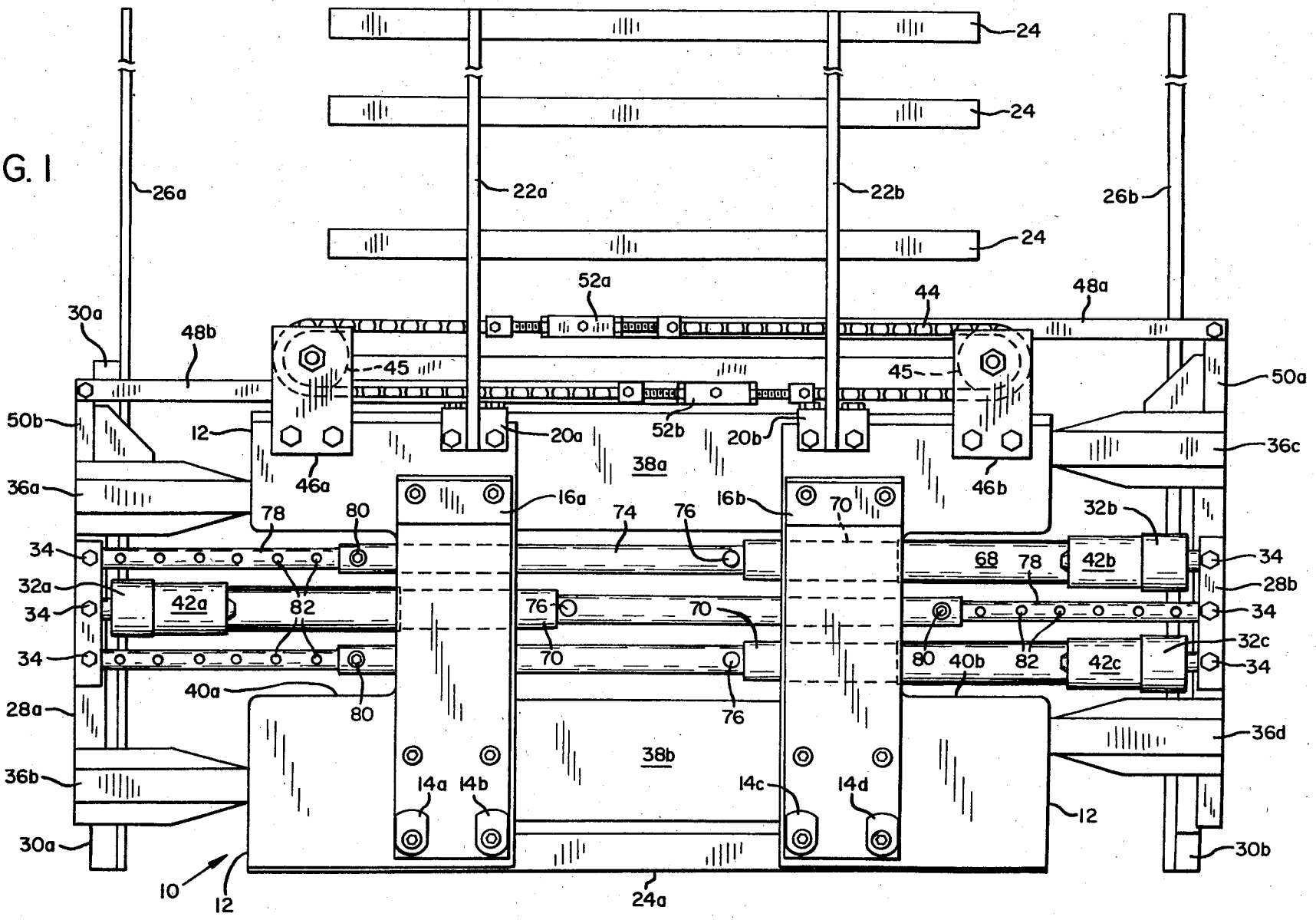
FIG. 1 is a rear view of an exemplary embodiment of a carton clamp mechanism of the present invention as viewed from the front of the vehicle to which the mechanism is to be mounted.

As seen in FIG. 1, the frame 12 includes cutout portions 40*a* and 40*b* which permit motors 42*a*, 42*b* and 42*c* of the linear actuators to move transversely with respect to the frame into and out of positions located between the transverse ends of the frame without having to clear the frame 12. This permits the clamp arms to close sufficiently to accommodate smaller loads while permitting the motors 42*a*, 42*b* and 42*c* to be mounted in a compact, rearwardly-overlapping relationship to the frame 12 whereby both the motors and the frame occupy an imaginary common plane extending vertically and transversely through the frame 12 (such as the plane defined by the surface 12*a* in FIG. 2). Mounting the motors in this compact fashion minimizes what is known as the "lost load" factor, which is the forward distance extending between the materials handling vehicle and the rearward boundary of the load that is occupied by the clamp structure. The greater such distance, the less is the weight of the load that can be accommodated by the materials handling vehicle because of the downward moment imposed by the load on the vehicle. Without the cutouts 40*a* and 40*b*, the distance separating the clamp arms at maximum closure would be too great to accommodate smaller-sized loads.

Since the linear actuators connect the clamp arms 28*a* and 28*b* together independently of the frame 12, it is possible due to friction or other factors that one clamp arm could move faster than the other relative to the frame during opening or closing of the arms. This could cause the clamp arms to lose centering (or other appropriate referencing) with respect to the frame 12, and even to become so decentered that the slide members of one clamp arm could hyperextend and thereby become disengaged from the guides.

In the utilization of the clamp on an automatically-guided vehicle the retention of exact referencing with respect to the frame is critical since the vehicle automatically positions itself with respect to a load on the assumption that the clamp arms are in specific locations preparatory to clamping. In order to prevent loss of reference between the clamp arms and the frame 12, and to prevent hyperextension of the clamp arms, an endless referencing chain 44 is mounted on a pair of sheaves 45 which are affixed to the frame 12 by a pair of brackets 46*a* and 46*b* respectively. The chain 44 has a pair of links 52*a* and 52*b* respectively which divide the chain into two segments of equal length. Each link 52*a* and 52*b* is connected to a respective clamp arm by a respective connecting rod 48*a* and 48*b* and bracket 50*a* and 50*b*. The chain 44 equalizes the speeds at which the respective clamp arms move transversely relative to the frame 12 as the screw elements of the actuators are turned to open or close the arms. Thus, even if movement of the slide members of one clamp arm is opposed by less friction than the slide members of the opposite clamp arm, tending to make one move faster than the other, the resultant force differential is transferred from one arm to the other through the chain 44 thereby preventing the arms from moving at different speeds. Thus chain 44 maintains the clamp arms 28*a* and 28*b* equidistant from the center, or other desired reference point, of the frame 12.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A motor-actuated load-engaging clamp adapted to be fitted to a materials handling machine comprising:

(a) a frame adapted to extend vertically and transversely relative to said machine;

(b) a pair of selectively openable and closeable clamp arms extending forwardly from said frame movably mounted thereon for transverse movement relative to said frame and to each other;

(c) elongate screw actuator means, having mutually-cooperating turnable and nonturnable elements, interconnecting said pair of clamp arms for selectively closing them by turning the turnable element in one rotational direction and, alternatively, selectively opening them by turning the turnable element in the opposite rotational direction so as to move said clamp arms transversely relative to said frame selectively either toward or away from each other;

(d) said turnable element having an axis of rotation extending transversely relative to said frame, and both said turnable element and said nonturnable element of said screw actuator means being mounted for movement transversely relative to said frame in a direction along said axis of rotation; and (e) motor means for turning said turnable element while permitting said turnable element to move transversely relative to said frame in said direction along said axis of rotation.

2. The load-engaging clamp of claim 1, further including means for equalizing the speeds at which said respective clamp arms move transversely relative to said frame as said turnable element turns.

3. The load-engaging clamp of claim 1 wherein said turnable element of said elongate screw actuator means is attached to one of said clamp arms for movement transversely in unison therewith, and said non-turnable element is attached to the other one of said clamp arms for transverse movement in unison therewith.

4. The load-engaging clamp of claim 1 wherein said motor means is mounted for transverse movement relative to said frame.

5. The load-engaging clamp of claim 4 wherein said motor means is attached to one of said clamp arms for transverse movement in unison therewith.

6. The load-engaging clamp of claim 4 wherein said motor means and said frame occupy a common plane extending vertically and transversely through said frame.

7. The load-engaging clamp of claim 6 wherein said frame has a pair of transverse ends and said motor means is movable transversely relative to said frame to a position wherein said motor means is located at least partially between said transverse ends of said frame, said frame having means defining a cutout therein for accomodating said motor means in said position.

8. The load-engaging clamp of claim 1 wherein said elongate screw actuator means includes multiple pairs of said turnable and nonturnable elements interconnecting said pair of clamp arms, and said motor means includes multiple motors each connected to a respective turnable element of one of said pairs.

9. The load-engaging clamp of claim 1 wherein said clamp arms are slidably mounted on said frame for transverse movement relative to said frame and to each other.

10. A motor-actuated load-engaging clamp adapted to be fitted to a materials handling machine comprising:

(a) a frame adapted to extend vertically and transversely relative to said machine;

(b) a pair of selectively openable and closeable clamp arms extending forwardly from said frame movably mounted thereon for transverse movement relative to said frame and to each other;

(c) elongate screw actuator means, having mutually-cooperating turnable means and nonturnable means respectively, interconnecting said pair of clamp arms for selectively closing them by turning the turnable means in one rotational direction and, alternatively, selectively opening them by turning the turnable means in the opposite rotational direction so as to move said clamp arms transversely relative to said frame selectively either toward or away from each other; and (d) motor means connected to said turnable means for turning said turnable means, said motor means comprising multiple rotary motors having respective axes of rotation extending transversely relative to said frame, each of said motors being connected through said turnable means of said screw actuator means to both of said clamp arms so as to exert force on both of said clamp arms, said motors being positioned at different vertical elevations relative to said frame, and said motors and said frame occupying a common plane extending vertically and transversely through said frame.

11. The load-engaging clamp of claim 10 wherein said multiple rotary motors are free of any connection to said frame, other than through their connection to said turnable means, capable of preventing movement of said motors transversely relative to said frame in a direction along their respective axes of rotation, further including means for equalizing the speeds at which said respective clamp arms move transversely relative to said frame as said turnable means turns.

12. The load-engaging clamp of claim 10 wherein said frame has a pair of transverse ends and means defining a cutout between said ends for permitting said motors to occupy said common plane while also permitting said motors to be located at least partially between said transverse ends of said frame.

* * * * *